US007036690B2

(12) United States Patent
Tsubaki et al.

(10) Patent No.: US 7,036,690 B2
(45) Date of Patent: May 2, 2006

(54) DISCHARGE CONTAINER

(75) Inventors: Tatsuo Tsubaki, Tokyo (JP); Shigeo Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/529,641

(22) PCT Filed: Oct. 20, 2003

(86) PCT No.: PCT/JP03/13362

§ 371 (c)(1),
(2), (4) Date: Apr. 29, 2005

(87) PCT Pub. No.: WO2004/035420

PCT Pub. Date: Apr. 29, 2004

(65) Prior Publication Data

US 2005/0242129 A1 Nov. 3, 2005

(30) Foreign Application Priority Data

Oct. 18, 2002 (JP) ..... 2002-303861
Oct. 21, 2002 (JP) ..... 2003-306008

(51) Int. Cl.
*B65D 37/00* (2006.01)

(52) U.S. Cl. ..... 222/215; 222/481.5

(58) Field of Classification Search ..... 222/192, 222/215, 481.5
See application file for complete search history.

(56) References Cited

U.S. PATENT DOCUMENTS 6,581,803 B1 * 6/2003 Yoshimoto et al. ..... 222/481.5

FOREIGN PATENT DOCUMENTS

JP 2002-036344 A 2/2002
JP 2003-319818 A 11/2003

* cited by examiner

*Primary Examiner*—Philippe Derakshani
(74) *Attorney, Agent, or Firm*—Oliff & Berridge, PLC

(57) ABSTRACT

The object of this invention is to provide a delaminated bottle, which has a base cup fitted tightly around the bottom cylinder of the container and in which a slit is opened easily for the introduction of outside air into the interspace between the outer layer and the inner layer.

The container has a male screw on the outer wall of container bottom cylinder and the base cup has a female screw, which is disposed in the upper portion of the inner surface of cylindrical cup wall and is screwed on the container bottom cylinder. The base cup has also an upright pushing section disposed in the lower portion of the inner surface of the cylindrical cup wall, and this upright pushing section pushes up on the walled bottom plate so as to open a slit in the outer layer of the pinch-off portion when the base cup is engaged with the male screw.

Thus, the upright pushing section pushes up on the underside of the walled bottom plate at the time when the base cup is firmly fitted around the container bottom cylinder. The bottom seal is deformed and curved to open a slit easily and reliably so that outside air is introduced into the interspace between the outer layer and the inner layer.

14 Claims, 15 Drawing Sheets

DISCHARGE CONTAINER

TECHNICAL FIELD

This invention relates to a discharge container from which the contents can be discharged without allowing outside air to enter the inside of the container. In particular, this invention relates to what is called a delaminated bottle, which comprises a container having an outer layer and an inner layer laminated to each other in a peelable manner and also comprises a base cup combined with the container by fitting the base cup around the bottom cylinder of the container.

BACKGROUND ART

Discharge containers molded by blow molding are well known and are generally called the delaminated bottles. Such a bottle comprises an outer layer that has been formed in a given shape and has a high ability to retain its own shape, an inner layer in the shape of a highly flexible pouch laminated to the outer layer in an easily peelable manner, a neck, which is disposed in the upper portion of the container and is used as a discharge port for the contents, and an air intake port for introducing outside air into the interspace between the outer and inner layers.

The blow-molded and laminated discharge container is molded by extrusion-molding laminated parison obtained from the co-extrusion of an outer-layer parison and an inner-layer parison having little compatibility with each other, holding tight and pressing the bottom with the pinch-off part of the blow-molding tool to adhere or attach the laminates to each other, and blow-molding the laminated and bottomed parison. Basically, the bottom seal has the laminated structure comprising the outer layer and the inner layer, which are scarcely compatible with each other. Naturally, sometimes there occurs a bottom crack in the outer layer.

If this bottom crack develops, a slit is formed in the bottom of the discharge container. As a result, the container bottom would have weak mechanical strength. If the container is used in the environment where much water is used, then water may inconveniently pass through the slit into the interspace between outer and inner layers concurrently with the peeling and deflation of the inner layer.

Conventionally, these problems have been dealt with by utilizing a special pin or an adhesive layer, which strongly fusion-bonds or adheres the outer and inner layers of the bottom seal so that cracking in the bottom seal can be prevented from occurring. Instead, an air intake port was opened by exclusive processing in the neck or in the outer layer of the body of the discharge container. In this manner, the bottom of the molded discharge container could have high and stable mechanical strength. In addition, the air intake port was disposed at a place capable of introducing outside air smoothly without giving damage to the outer appearance of the discharge container.

In the meantime, an air intake hole can be molded quite simply and reliably when the slit is opened by the cracking in the bottom seal and is used to serve as the port for introducing outside air into the interspace between the outer layer and the inner layer. Inventions utilizing such a slit are known in the art. See, for example, Patent Document 1, in which a base cup is fitted around the bottom cylinder of a discharge container. The base cup is provided with a pushing section to push the sidewall of the bottom cylinder of the container. At the time when the base cup is fitted around the bottom cylinder of the container, the force pushing the bottom cylinder is conveyed to the bottom seal, and a crack develops in the outer layer. The slit thus formed can be used to serve as the air intake hole.

[Patent Document 1] Publication No. P1997-301404

In the case of the container made of soft materials, it may happen that the base cup cannot be fixed to the bottom of the container with sufficient fitting force.

The object of this invention is to solve the above-described problems and to provide a discharge container which has a base cup fitted tightly around the bottom cylinder of the container and in which the bottom seal can be cracked reliably so that a slit is formed easily and reliably for the introduction of outside air into the interspace between the outer layer and the inner layer.

DISCLOSURE OF THE INVENTION

The above-described problems can be solved by the discharge container of the invention according to claim 1. The discharge container comprises:

a container, which has been blow-molded from cylindrical parison and has a neck disposed in the upper portion of said container in a bottomed cylindrical shape and has said neck connected to discharge ports, through which contents are discharged, a walled bottom plate in the lower portion of the container, an outer layer and a flexible inner layer that are laminated with each other in a peelable manner, and a bottom seal, which is a pinch-off portion of the parison, formed on the underside of the walled bottom plate; and a base cup, which is fitted to bottom cylinder of the container and comprises a cylindrical wall and a cup bottom plate contiguously formed with said cylindrical wall, wherein the discharge container is characterized in that the container has a first engaging portion on the wall of the bottom cylinder and that the base cup has a second engaging portion, which is disposed on the inner cup wall and is engaged with the first engaging portion, an air intake hole to take in air, and a pushing means to be brought into contact with the container bottom cylinder, and wherein said pushing means comes in contact with the container bottom cylinder and opens a slit in the outer layer of the pinch-off portion when the base cup is fitted around the bottom cylinder of said container by engaging the second engaging portion with the first engaging portion of the container.

According to the invention as described in claim 1, the pushing means comes in contact with the bottom cylinder, and the slit is opened in the outer layer of the bottom seal, when the base cup is fitted around the bottom cylinder of the container. In this manner, the slit serving as an air intake hole can be formed easily and reliably. The pushing means may be an upright pushing section, such as an upright bar, which projects from a support wall and directly pushes up on the underside of the bottom cylinder, or may be a pinch/push section that pushes the bottom cylinder laterally to deform the same. In any event, the point is that a slit is formed by fitting the base cup around the bottom cylinder. There is no specific requirement for the method of fitting the base cup through the engagement of the first and second engaging portions, and thus, it is free to use screw engagement or undercut engagement as one skilled in the art may determines.

The invention as described in claim 2 has the configuration that the pushing means specified in the discharge container of claim 1 is an upright pushing section disposed inside the cup bottom plate, and this pushing section stands upright toward the underside of the walled bottom plate. When the base cup is fitted around the container bottom cylinder, the upright pushing section pushes up on the underside of the walled bottom plate so that a slit is opened in the outer layer of the bottom seal.

In the invention as described in claim 2, the upright pushing section pushes up on the underside of the walled bottom plate by fitting the base cup around the container bottom cylinder. Since the pushing force of the upright pushing section acts on the bottom plate that is thicker than the body, this force is not deconcentrated but serves directly to deform and curve the bottom seal. Thus, the slit can be opened easily and reliably, and outside air is introduced through the slit into the interspace between the outer layer and the inner layer.

The invention as described in claim 3 has the configuration that the upright pushing section specified in the discharge container of claim 2 is disposed at a position deviated from the center of the cup bottom plate. With the rotation of the base cup, the upright pushing section also enters a circular orbit, while pushing up on the underside of the walled bottom plate. Because of this circular movement, the slit can be opened without fail.

The invention as described in claim 4 has the configuration that the upright pushing section specified in the invention of claim 2 is disposed in the center of the cup bottom plate. This makes it possible for the upright pushing section to push up directly on the center of the pinch-off portion, and thereby, to open the slit without fail.

The invention as described in claim 5 has the configuration that, in the invention of either one of claims 1 to 3, the air intake hole is disposed in the center of the cup bottom plate. Under this configuration, outside air can be introduced smoothly into the interspace between the outer and inner layers.

The invention as described in claim 6 has the configuration that the pushing means specified in the discharge container of claim 1 is a pinch/push section, which is disposed inside the base cup and pushes the walled bottom plate laterally from both sides. When the base cup is fitted around the container bottom cylinder, such a pinch/push section pushes the bottom cylinder so as to open a slit in the outer layer of the bottom seal.

In the invention as described in claim 6, the pinch/push section pushes the bottom plate of the container bottom cylinder laterally during the screw engagement with the base cup. Since the base cup is rotated to push the sidewall gradually, only small power is required for the fitting, and the necessary pushing force can be reliably applied to the bottom plate of the bottom cylinder. The slit can be opened easily and reliably in the walled bottom plate so that outside air is introduced into the interspace between the outer layer and the inner layer.

The invention as described in claim 7 has the configuration that the discharge container specified in claim 6 is provided with a pinch/push section, which comprises at least a pair of mounds rising from the inner surface of the cup bottom cylinder, with the length between two mounds being shorter than the outer diameter of the walled bottom plate. Under this configuration, the walled bottom plate of the container bottom cylinder is held tight between the pair of mounds and is pushed laterally. Thus, the slit is formed in the bottom seal without fail.

The invention as described in claim 8 has the configuration that, in the discharge container of claim 6, the pinch/push section is a pushing wall, which is disposed inside the cup cylindrical wall and is allowed to stand from the cup bottom plate, with a narrow space separating the cup bottom cylinder from the cylindrical wall. Under this configuration, any reaction force arising from the pressure onto the bottom plate is hardly transmitted from the pinch/push section to the female screw. Therefore, there occurs no loose screw engagement nor is there any damage to air-tightness between the screws.

The invention as described in claim 9 has the configuration that, in the discharge container specified in either one of claims 6–8, the walled bottom plate is formed in an elliptical or oval shape, with its major axis being set in the direction of parting line and the length between two mounds of the pinch/push section set shorter than the major axis. Under this configuration, the major-axis portion of the walled bottom plate is held tight by the pinch/push portion of the base cup and is pushed and deformed to form a slit in the bottom seal.

The invention as described in claim 10 has the configuration that, in the discharge container specified in either one of claim 6–9, the pinch/push section is formed in the elliptical or oval shape, in which the major axis is longer, and the minor axis is shorter, than the outer diameter or major axis of the walled bottom plate. Under this configuration, the walled bottom plate is held tight by the pinch/push section of the base cup, and is pushed and deformed to open the slit in the bottom seal.

The invention as described in claim 11 has the configuration that, in the discharge container specified in either one of claims 6–10, the pinch/push section is formed in a tapered shape, with its diameter being shorter in the lower portion than in the upper portion. Under this configuration, the pushing force applied to the bottom plate increases when the rotation of the base cup goes on little by little. The slit in the container bottom can be formed reliably as the screw engagement with the base cup goes on.

The invention as described in claim 12 has the configuration that the squeezable container of the discharge container specified in either one of claims 1–11 comprises a first check valve, which is disposed at the neck of the container and freely opens or closes the neck to prevent the contents from flowing back into the container and to inhibit the inflow of outside air; and a second check valve fitted to the air intake hole to prevent inside air from escaping outside. Under this configuration, the contents inside the inner layer can be discharged while preventing air from flowing into the container, and the slit can be easily formed in the pinch-off portion even in the case of a relatively soft, squeezable container.

The invention as described in claims 13 and 14 has the configuration that, in the invention of either one of claims 1–12, the engaging portions have a structure in which the first engaging portion is brought into undercut or screw engagement with the second engaging portion. This configuration ensures that the base cup can be fitted firmly around the container.

PREFERRED EMBODIMENTS OF THE INVENTION

Figure 1:
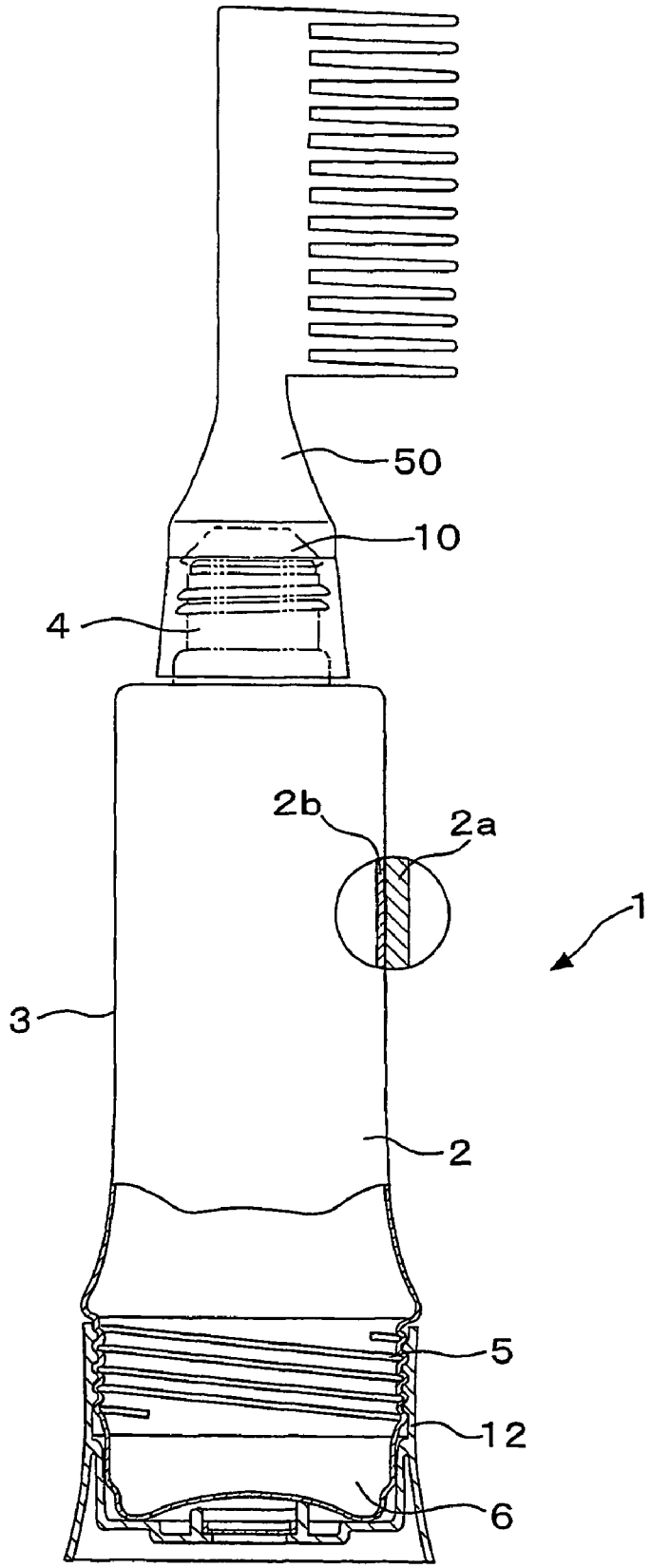
FIG. 1 is a front elevational view showing the discharge container in one embodiment of this invention, accompanied by a partially enlarged and vertically sectioned view.

The discharge container of this invention is further described with respect to preferred embodiments, now referring to the drawings.

FIG. 1 shows the discharge container in a preferred embodiment of this invention. The discharge container 1 comprises a container 2 and a base cup 12, which is fitted around the bottom cylinder 6 of the container 2. A comb/brush attachment 50 is fitted detachably to the upper portion of the container 2.

The container 2 is a blow-molded product in which an outer layer 2*a* is laminated with an inner layer 2*b*, as shown in the circle of FIG. 1. The outer layer 2*a* is made of a synthetic resin material, such as high-density polyethylene, polypropylene, polyethylene terephthalate, and the like, and is molded in a squeezable manner while giving an ability to retain its own shape as required. The inner layer 2*b* is made of a synthetic resin material, such as nylon, ethylene vinyl alcohol copolymer, low-density polyethylene, and the like, which is less compatible with the outer layer 2*a*, and is molded in the shape of a freely distorted bag.

The outer layer 2*a* and the inner layer 2*b* of the container 2 may be of a single-layer structure or a laminated structure. For suitable distortion of the inner layer 2*b*, it is preferred that the outer layer 2*a* and the inner layer 2*b* are adhered and fixed by at least a strip-shaped adhesive layer (not shown) disposed over the entire height of the container 2. There is no special limitation to the number and width of the adhesive layer as far as there is an adhesive layer or more. For the squeezable type of discharge container, preferably the adhesive layers are disposed at axisymmetrical positions. In addition, it is preferred for the purpose of reducing the remaining contents that two strips of adhesive layers are disposed axisymmetrically on the parting line P or that four strips of adhesive layers are disposed axisymmetrically at nearby positions straddling the parting line P.

Body 3 of the container 2 has a cylindrical shape. A neck 4 for use as the discharge port of the contents is disposed at the upper end of the body 3 and is provided with a spiral thread ridge on the outer peripheral surface. A bottom cylinder 6 in the bottomed cylindrical shape is disposed in the lower portion of the body 3, and is provided with a male screw 5, which is a spiral thread ridge to be used as the first engaging portion. The neck 4 is provided with the first check valve 10 to prevent the backflow of the contents and the inflow of outside air. The above-described comb/brush attachment 50 is fitted to the neck 4 so that the contents, such as a chemical agent, can be discharged from the tips of the teeth, under the condition that the teeth are internally connected to the neck 4.

Figure 2:
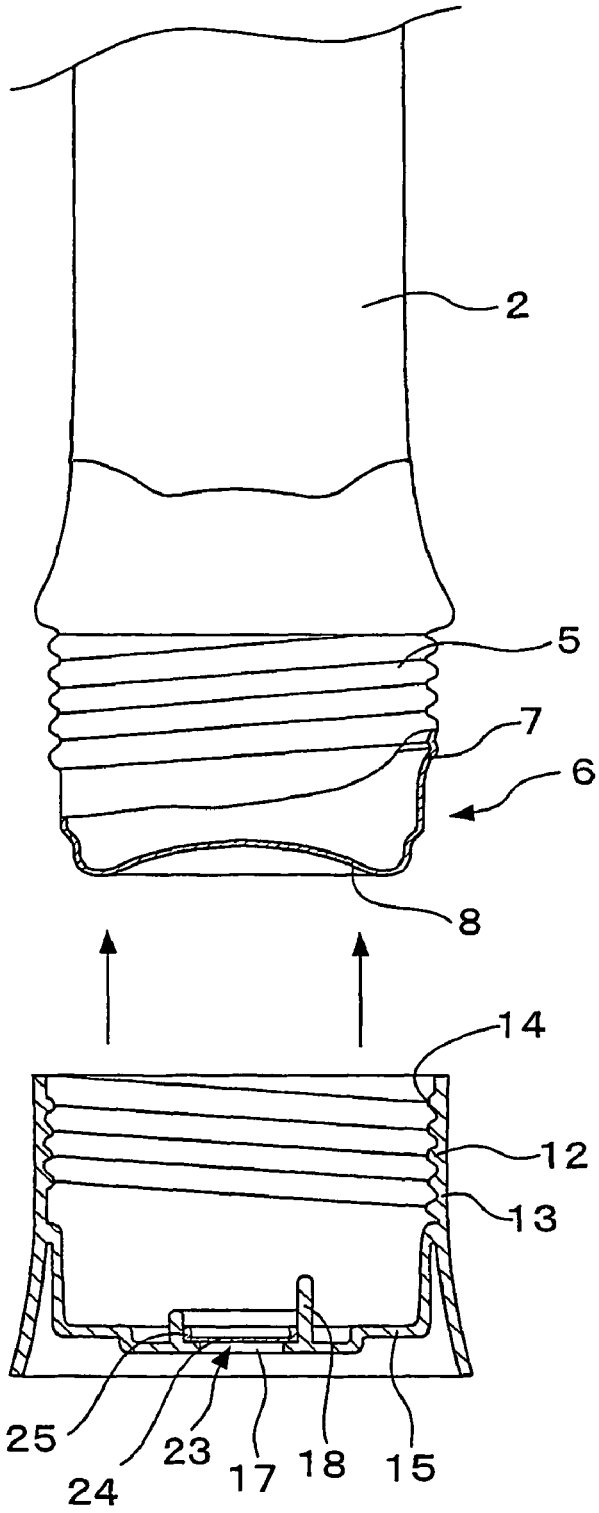
FIG. 2 is a side, vertical sectional view of the container bottom cylinder and the base cup.
Figure 3:
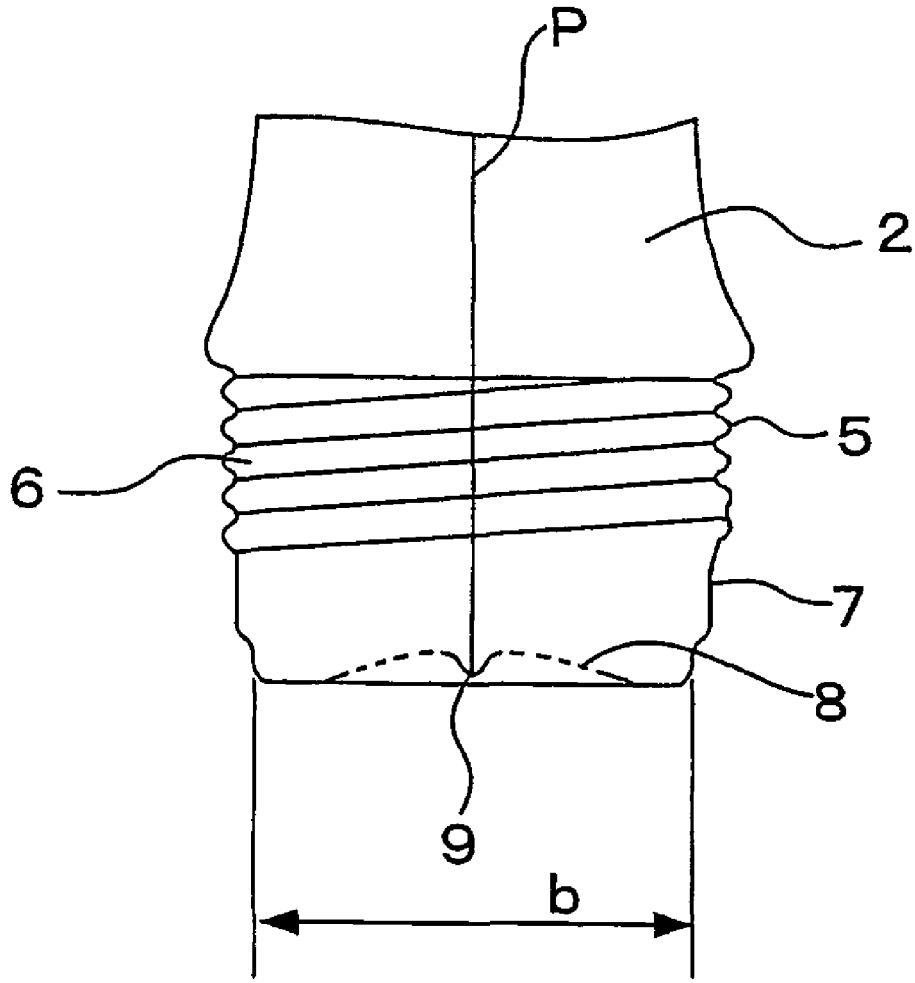
FIG. 3 is a partial side view showing the container bottom cylinder.
Figure 4:
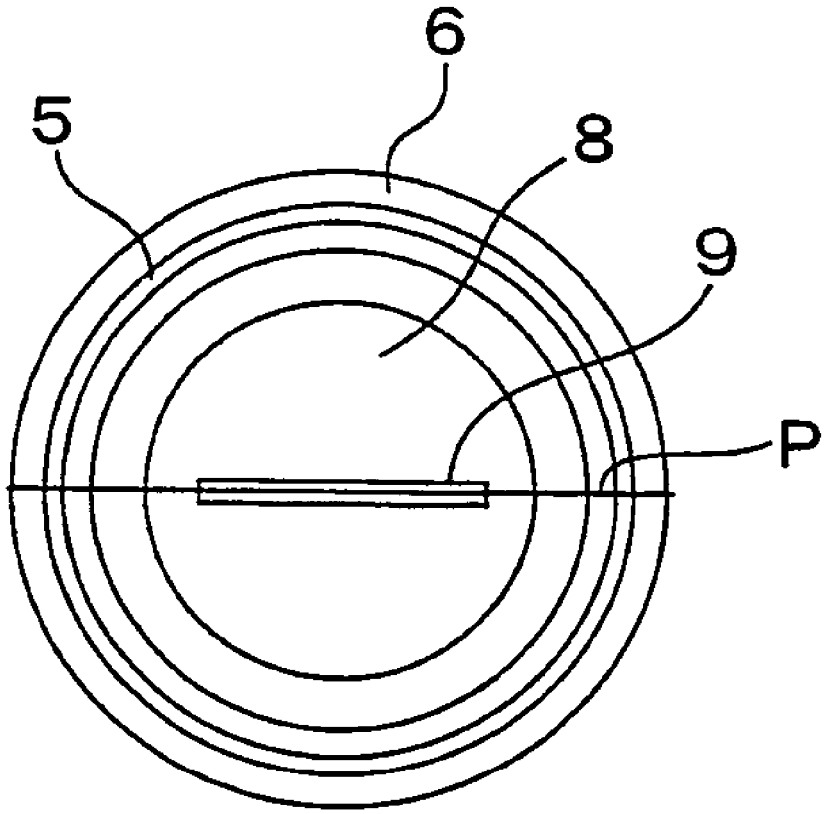
FIG. 4 is a bottom plan view of the container.
Figure 5:
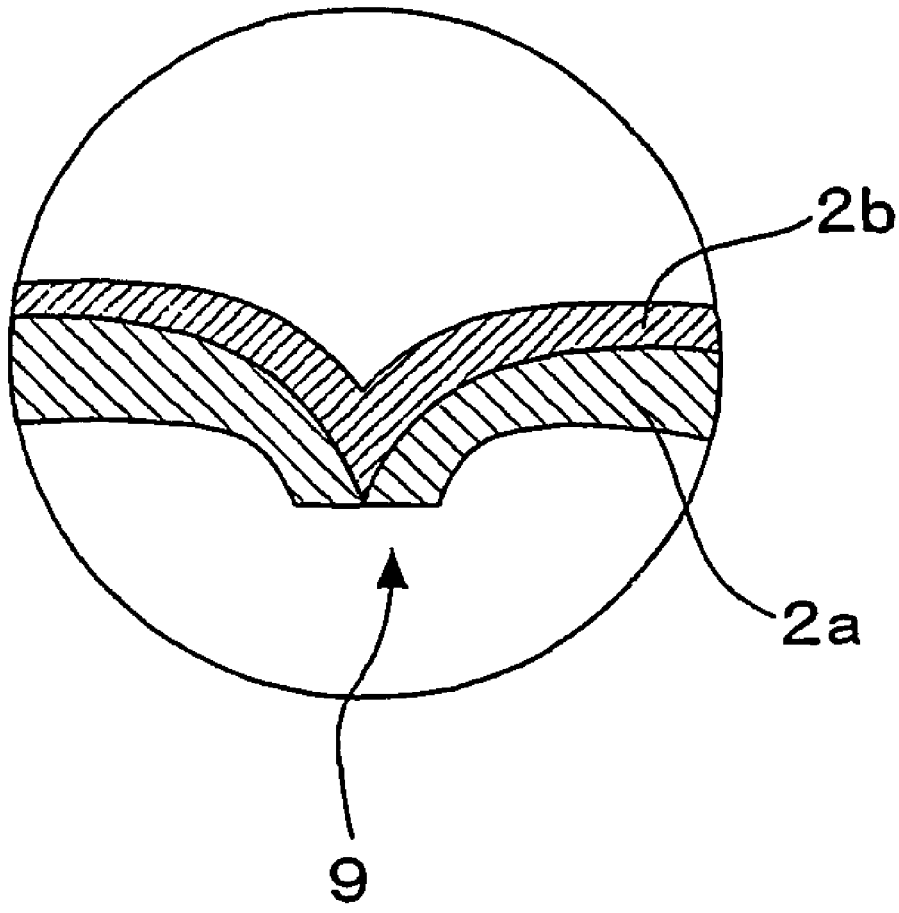
FIG. 5 is an enlarged vertical section showing the bottom seal.

As shown in FIG. 2, the container bottom cylinder 6 comprises a peripheral wall 7 having a male thread ridge 5 disposed circumferentially on the outer surface of the peripheral wall 7, and also comprises a walled bottom plate 8, which is disposed at the lower end of the peripheral wall 7 and is caved in toward the inside of the container 2. A bottom seal 9, i.e., the pinch-off portion of the parison, forms a ridge along the parting line P on the underside of the central portion of the walled bottom plate 8, as shown in FIGS. 3 and 4. FIG. 5 shows a vertical section of the bottom seal 9. As shown, both ends of the inner layer 2*b* are adhered to each other at the bottom seal 9, and the joined inner layer 2*b* is attached to the inner walls of the right and left outer layers 2*a*.

The base cup 12 has been injection-molded using polyethylene, polypropylene, ABS, AS, and the like. As shown in FIG. 2, a female thread ridge 14 is used as the second engaging portion, which comes in screw engagement with the male screw 5 on the container 2, and is disposed around the inner surface of cylindrical wall 13 of the base cup 12 in the bottomed cylindrical shape. Cup bottom plate 15 in a flat disc shape is disposed integrally at the lower end of the cylindrical wall 13.

A valve support cylinder 16 stands in the center of the cup bottom plate 15. An opening 17 that serves as the air intake hole opens in the center of the valve support cylinder 16. A second check valve 23 is fitted air-tightly inside the valve support cylinder 16. The second check valve 23 comprises a valve membrane 24, which is fitted to a valve frame 25 so as to open or close the opening 17 freely. Thus, the second check valve 23 serves to take in outside air into the base cup, but when air that has been taken in starts to escape outside, the valve membrane 24 closes to prevent air from escaping outside.

A part of the valve support cylinder 16 is raised to form an upright pushing section 18 in the shape of an upright bar, which is disposed in the open space inside the cylindrical wall 13. As the base cup 12 is screwed on the container bottom cylinder 6, the upright bar 18 reaches a point where it pushes up on the underside of the walled bottom plate 8.

Figure 6:
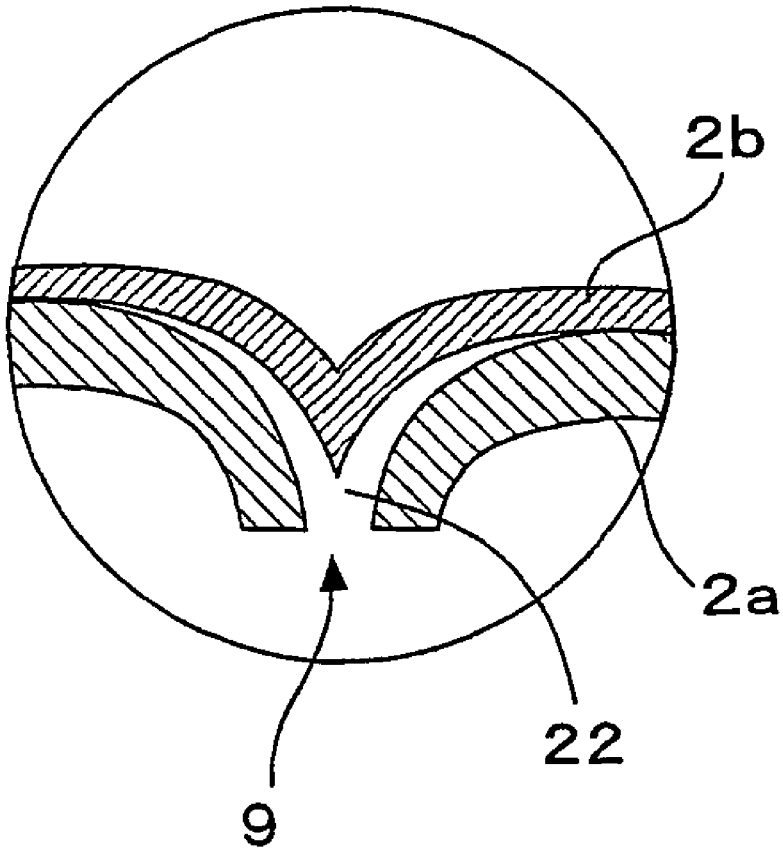
FIG. 6 is an enlarged vertical section showing the slit in the open state.

Under this configuration of the discharge container 1, the base cup 12 is screwed on the bottom cylinder 6 of the molded container 2. Then, the upright bar 18 comes to contact with the underside of the walled bottom plate 8, and pushes up on the underside as the base cup 12 is allowed to proceed further with the screw engagement. Soon the walled bottom plate 8 is deformed and curved, and the inner layer 2*b* begins being peeled from the outer layer 2*a* at the bottom seal 9. Thus, the slit 22 opens as shown in FIG. 6, and allows air to enter the interspace between the outer layer 2*a* and the inner layer 2*b*. The upright bar 18 pushes up on the underside to separate the outer layer 2*a* from the inner layer 2*b*, but does not force the inner layers 2*b* to split from each other. Therefore, an air intake hole is formed in the center of the walled bottom plate 8 so that outside air is introduced into the interspace between the outer layer 2*a* and the inner layer 2*b*.

As the screwing of the base cup 12 goes on, the male screw 5 is engaged with the female screw 14, and the base cup 12 is fitted tightly to the bottom cylinder 6 of the container 2.

A method of utilizing the discharge container 1 is now described. A chemical agent, for example, is put inside the inner layer 2*b* of the discharge container 1. When the body 3 is squeezed from both sides under the condition that the comb/brush attachment 50 has been fitted to the neck 4, the inner layer 2*b* is pushed along with the outer layer 2*a*, and thus, the chemical agent is discharged from the tips of the comb/brush attachment 50. If the body 3 is released from the pressure, the inside of the container is placed under a negative pressure. But since the first check valve 10 closes and the second check valve 23 opens, outside air flows into the base cup 12, passes through the slit 22, and enters the interspace between the outer layer 2*a* and the inner layer 2*b*. Thus, the container 2 returns to the original shape. If the body 3 is squeezed again, pressure inside the base cup 12 rises because air is connected through the slit 22. But since the second check valve 23 closes, air remaining between the outer layer 2*a* and the inner layer 2*a* cannot go out. Instead, the inner layer 2*b* is pressurized due to a rise of inner pressure, and the chemical agent is discharged again from the comb/brush attachment 50. Therefore, the discharge container 1 is not deflated but keeps its appearances always constant. The chemical agent can be discharged from the comb/brush attachment 50 merely by squeezing the body 3.

Figure 7:
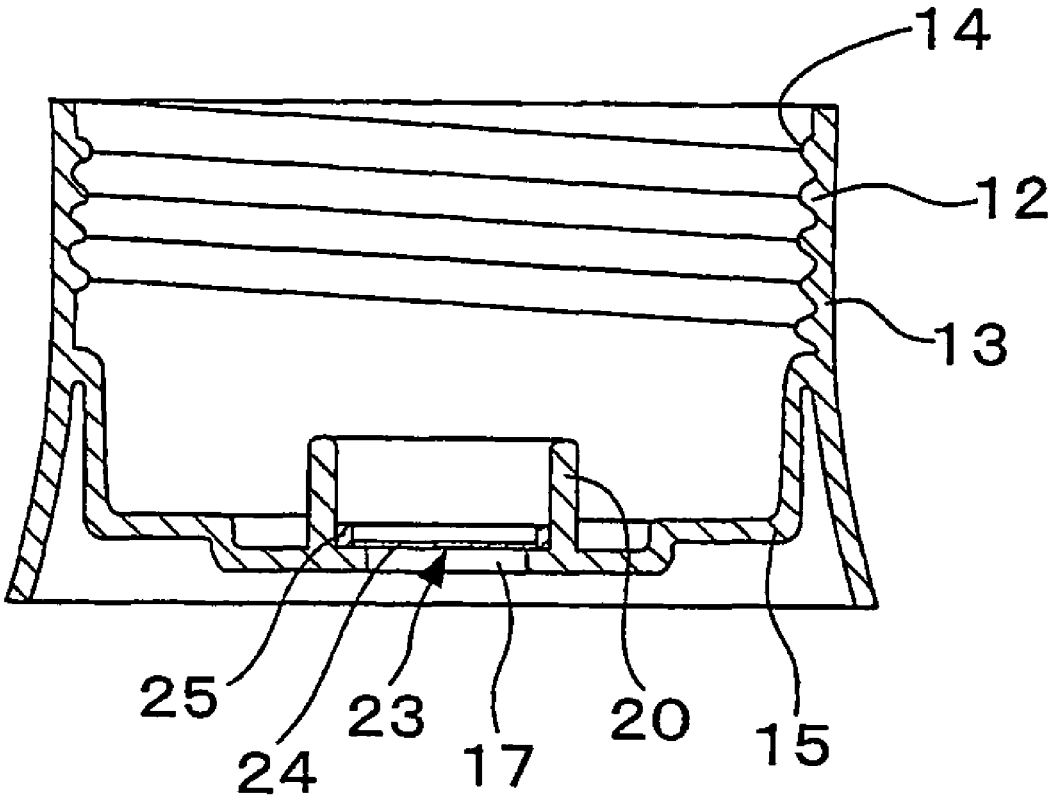
FIG. 7 is a vertical section showing the base cup in another embodiment of this invention.

FIG. 7 shows a base cup 12 in another embodiment of this invention. This base cup 12 comprises a valve support cylinder 16, the wall of which entirely stands upright, thus forming a cylindrical pushing wall 20. As the base cup 12 is screwed around the container 2, the cylindrical pushing wall 20 touches the walled bottom plate 8, pushes up on the underside, and opens the slit 22 at the bottom seal 9. In this embodiment, the cylindrical pushing wall 20 can be built strongly. Since this type of pushing section 20 gives large push-up force on the bottom seal 9, the slit 22 can be opened reliably.

Figure 8:
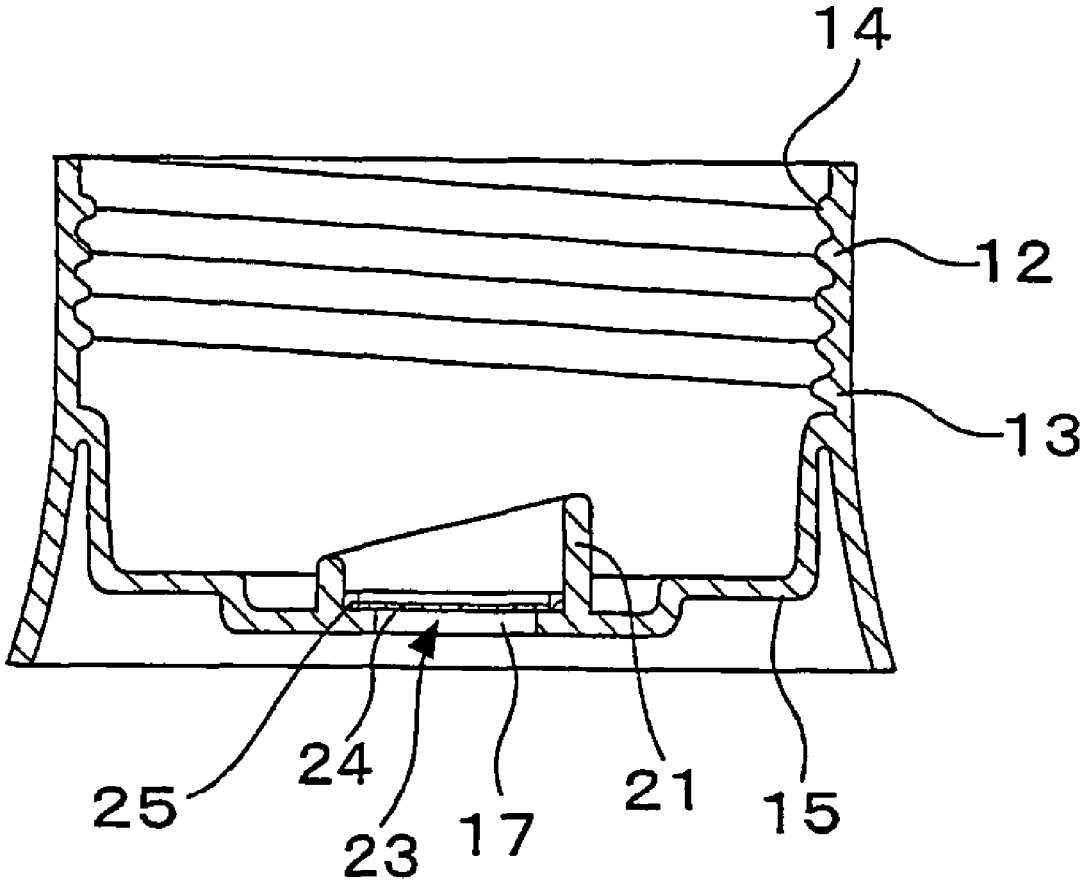
FIG. 8 is a vertical section showing the base cup in still another embodiment of this invention.

As shown in FIG. 8, an upright pushing section 21 may be formed in the shape of a slant-cut cylinder having the highest point at the upper end of an ellipse formed by the slant cut. Under this configuration, the slant-cut upright pushing section 21 has a sharp edge at the highest point, and can increase the pressure of contact with the walled bottom plate 8 when the base cup 12 is screwed on. Because the screw engagement rotates the slant-cut pushing section 21, there are changes in the points of contact where the slant-cut pushing section 21 pushes up on the walled bottom plate 8. Therefore, the bottom seal 9 can be opened easily.

Figure 9:
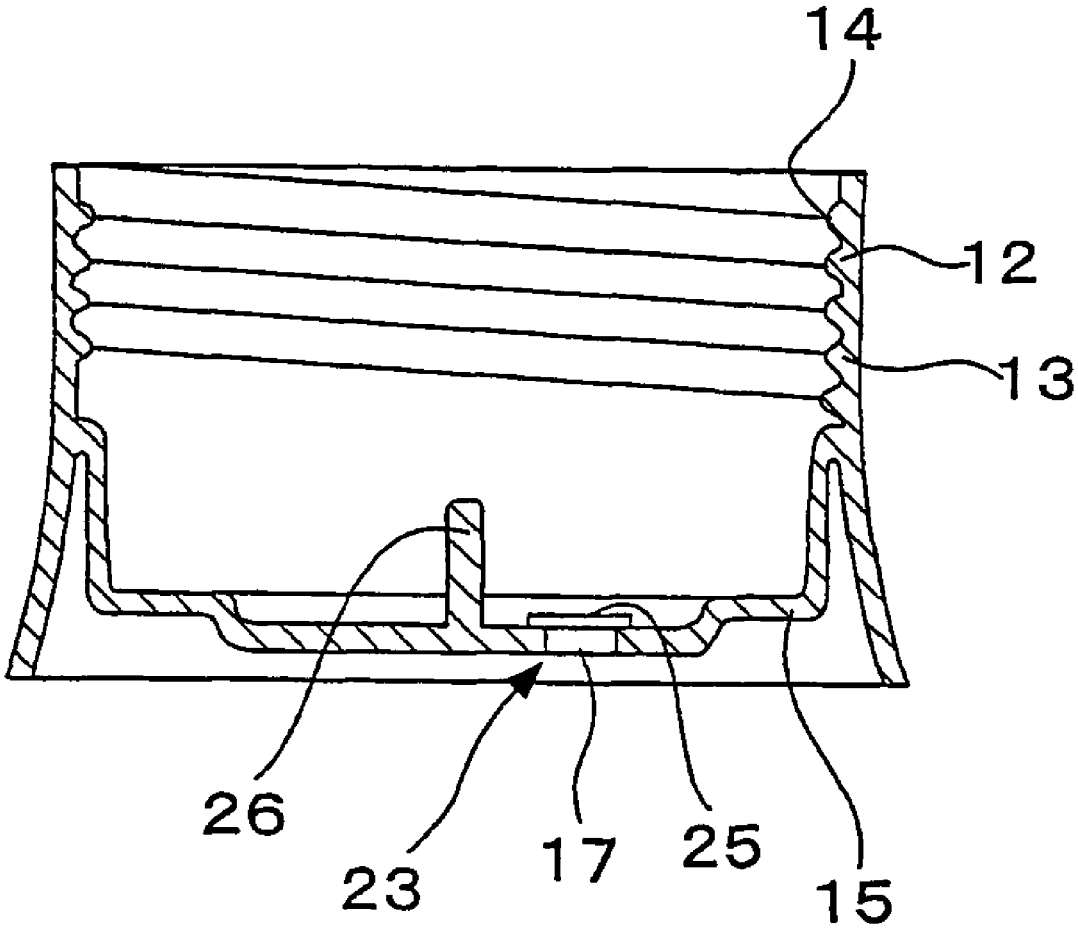
FIG. 9 is a vertical section showing the base cup in yet another embodiment of this invention.

Furthermore, as shown in FIG. 9, a rod-type upright pushing section 26 may be disposed in the center of the base cup 12. In that case, the connecting port 17 with a valve in the bottom plate is opened at a position deviated from the center of the base cup 12. Under this configuration, the pushing rod 26 pushes up on the bottom seal 9 at its center, and the slit can be opened without fail.

The inner layer 2*b* is flexible and there is no damage thereto even if the pushing rod 26, etc., happens to penetrate the outer layer 2*a* and reach the inner layer 2*b*. Meanwhile, the above embodiments have been described, taking a discharge container having a comb/brush attachment as an example. However, the discharge container as described in this invention is not limited to such a type. The neck 4 of the container 2 may be used as the spout of the discharge container, or any applicable unit other than the comb or the brush may be fitted to the container. Other dispensing devices, such as pump, trigger, and spray, may also be fitted to the neck as a component of the discharge container. In addition, the discharge container as described in this invention may be filled not only with the above-described chemical agent, but also with contents from various fields, including cosmetics, toiletry products, and foods.

Figure 10:
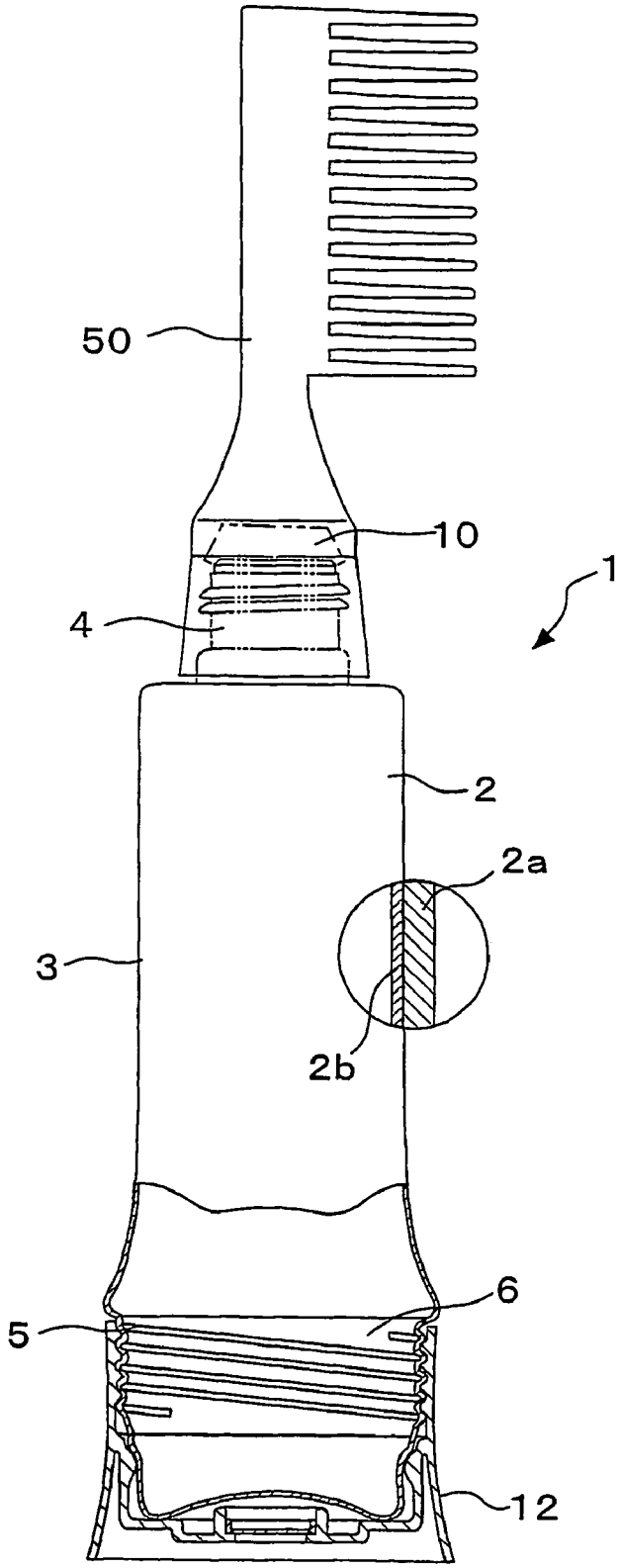
FIG. 10 is a front elevational view showing the discharge container in another embodiment of this invention, accompanied by a partially enlarged and vertically sectioned view.

FIG. 10 shows the discharge container in another preferred embodiment of this invention. The discharge container 1 comprises a container 2 and a base cup 12, which is fitted around the bottom cylinder 6 of the container 2. A comb/brush attachment 50 is fitted detachably to the upper portion of the container 1.

Such an embodiment will be described below, using the same codes for the same components as used in the above embodiments and focusing mainly on different points.

Similarly as in FIG. 2, the container bottom cylinder 6 comprises a peripheral wall 7 having a male thread ridge 5 disposed circumferentially on the outer surface of the peripheral wall 7, and also comprises a walled bottom plate 8, which is disposed at the lower end of the peripheral wall 7 and is caved in toward the inside of the container 2. A bottom seal 9, i.e., the pinch-off portion of the parison, forms a ridge along the parting line P on the underside of the central portion of the walled bottom plate 8, similarly as seen in FIG. 3 showing a side view of the bottom cylinder 6 and in FIG. 4 showing a bottom plan view. FIG. 5 shows a vertical section of the bottom seal 9. As shown, both ends of the inner layer 2*b* are adhered to each other at the bottom seal 9, and the joined inner layer 2*b* is attached to the inner walls of the right and left outer layers 2*a*.

Figure 11:
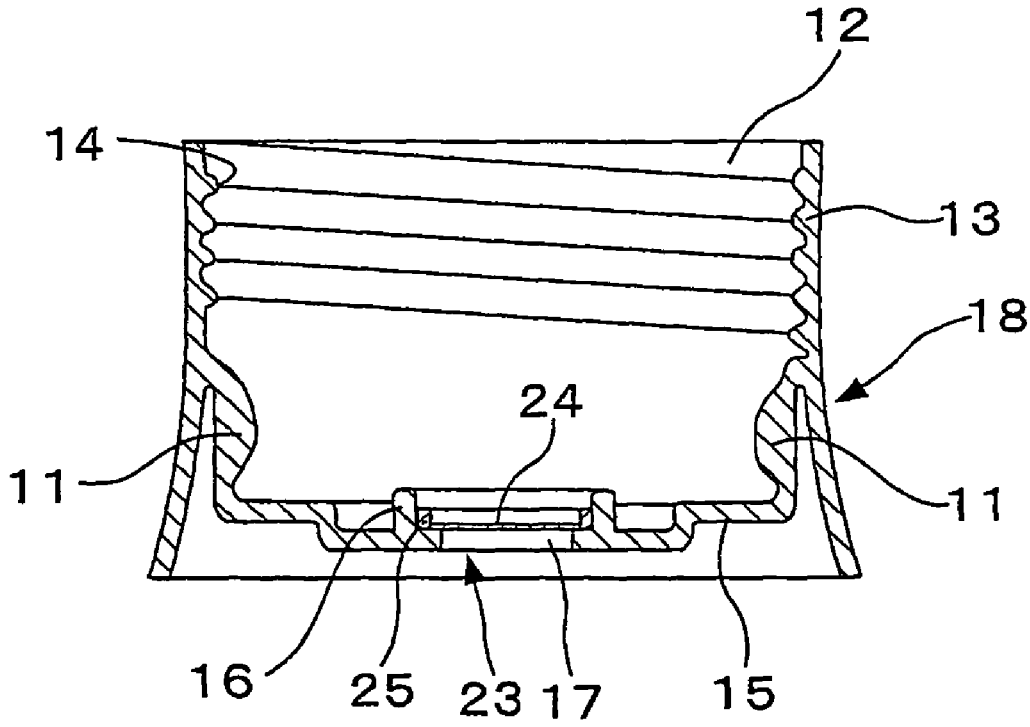
FIG. 11 is vertical section showing the base cup in yet another embodiment of this invention.

FIG. 11 shows the base cup 12, which has been injection-molded using polyethylene, polypropylene, ABS, AS, and the like. A female screw 14 is a spiral thread ridge, which comes in screw engagement with the male screw 5 on the container 2, and is disposed around the inner surface of cylindrical wall 13 of the base cup 12 in the bottomed cylindrical shape. Cup bottom plate 15 in a flat disc shape is disposed at the lower end of the cylindrical wall 13.

A valve support cylinder 16 stands in the center of the cup bottom plate 15. An opening 17 that serves as the air intake hole opens in the center of the valve support cylinder 16. A second check valve 23 is fitted air-tightly inside the valve support cylinder 16, and comprises a valve membrane 24, which is fitted to a valve frame 25 so as to open or close the opening 17 freely. Thus, the second check valve 23 serves to take in outside air into the base cup, but when air that has been taken in tries to escape outside, the valve membrane 24 closes to prevent air from escaping outside.

Figure 12:
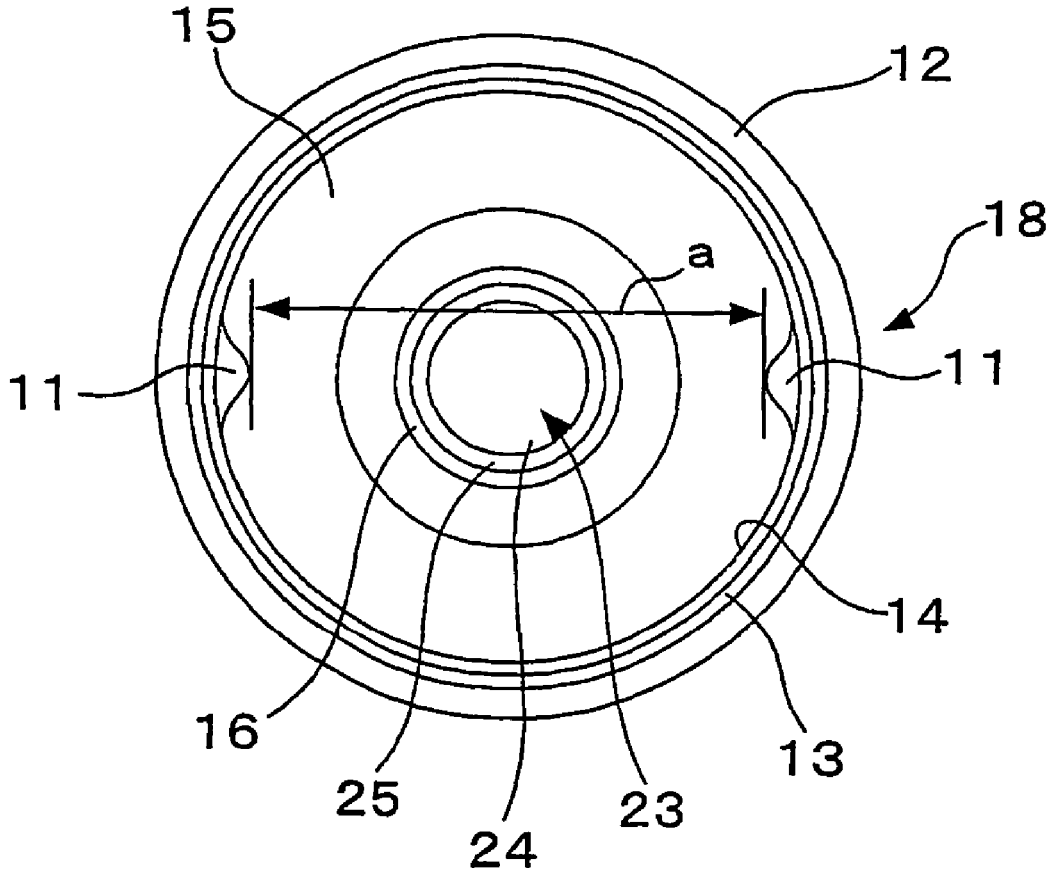
FIG. 12 is a plan view of the base cup.

On the inner surface of the cylindrical wall 13 are formed the mounds 11, which serve as the pinch/push section. As shown in FIG. 12, which is a plan view of the base cup 12, a pair of the mounds 11 is disposed axisymmetrically, facing each other across the central area of the base cup 12. The length (a) between both mounds 11 is shorter than the diameter (b) of the walled bottom plate 8 shown in FIG. 3. When the base cup 12 is screwed on the container bottom cylinder 6, the mounds 11 are disposed at positions where the sidewall of the walled bottom plate 8 always passes by, or comes in contact with, these mounds 11.

Under the configuration described above, the base cup 12 is screwed on the bottom cylinder 6 of the molded container 2. After the walled bottom plate 8 has passed by the female screw 14, the sidewall of the walled bottom plate 8 comes in contact with the mounds 11 and is held tight by the mounds 11, the core of the pinch/push section 18. Then, the walled bottom plate 8 receives the pushing force caused by the mounds 11 that holds tight the walled bottom plate 8. Especially when the parting line P passes by the positions of the mounds 11 during the rotation of the base cup 12, the bottom seal 9 is gradually pushed in the direction along the parting line. This pushing force serves to peel the inner layer 2*b* from the outer layer 2*a* and to widen the space between the outer layers on both sides. It is to be understood here that the pushing force peels the inner layer 2*b* from the outer layer 2*a*, but that the force does not separate the flexible inner layers that have been adhered together.

Several rows of a spiral thread ridge are formed on both of the bottom cylinder 6 of the container 2 and the inner surface of the cylindrical wall 13 of the base cup 12. Because of the spiral ridge and groove forms that serve as rib-like reinforcement, each of these screw portions have large mechanical strength. In addition, when the base cup 12 is screwed on the bottom cylinder 6 of the container 2, the fitting is further strengthened because of the screw engagement.

Consequently, as shown in FIG. 6, the slit 22 is opened in the bottom seal 9 and is used as the air intake hole, through which outside air is introduced into the interspace between the outer layer 2*a* and the inner layer 2*b*. Once the base cup 12 has been screwed on the bottom cylinder 6 of the container 2 and the male screw 5 has been engaged with the female screw 14, the base cup 12 is fitted to the container 2 tightly and strongly under the condition that the slit 22 remains open.

A method of utilizing the discharge container 1 is now described. A chemical agent, for example, is put inside the inner layer 2*b* of the discharge container 1. When the body 3 is squeezed from both sides under the condition that the comb/brush attachment 50 has been fitted to the neck 4, the inner layer 2*b* is pushed along with the outer layer 2*a*, and thus, the chemical agent is discharged from the tips of the comb/brush attachment 50. If the body 3 is released from the pressure, the inside of the container is placed under a negative pressure. But since the first check valve 10 closes and the second check valve 23 opens, outside air flows into the base cup 12, passes through the slit 22, and enters the interspace between the outer layer 2*a* and the inner layer 2*b* while preventing air from flowing into the inside of the container. Thus, the container 2 returns to the original shape. If the body 3 is squeezed again, pressure inside the base cup 12 rises because air is connected through the slit 22. But since the second check valve 23 closes, air remaining between the outer layer 2*a* and the inner layer 2*a* does not go out. Instead, the inner layer 2*b* is pressurized due to a rise of inner pressure, and the chemical agent is discharged again from the comb/brush attachment 50.

Therefore, the discharge container 1 is not deflated but keeps its appearances always constant after the chemical agent has been discharged. The chemical agent can be discharged from the comb/brush attachment 50 merely by squeezing the body 3. The number of the mounds 11 is not limited to a pair, but a few pairs may be disposed.

Figure 13:
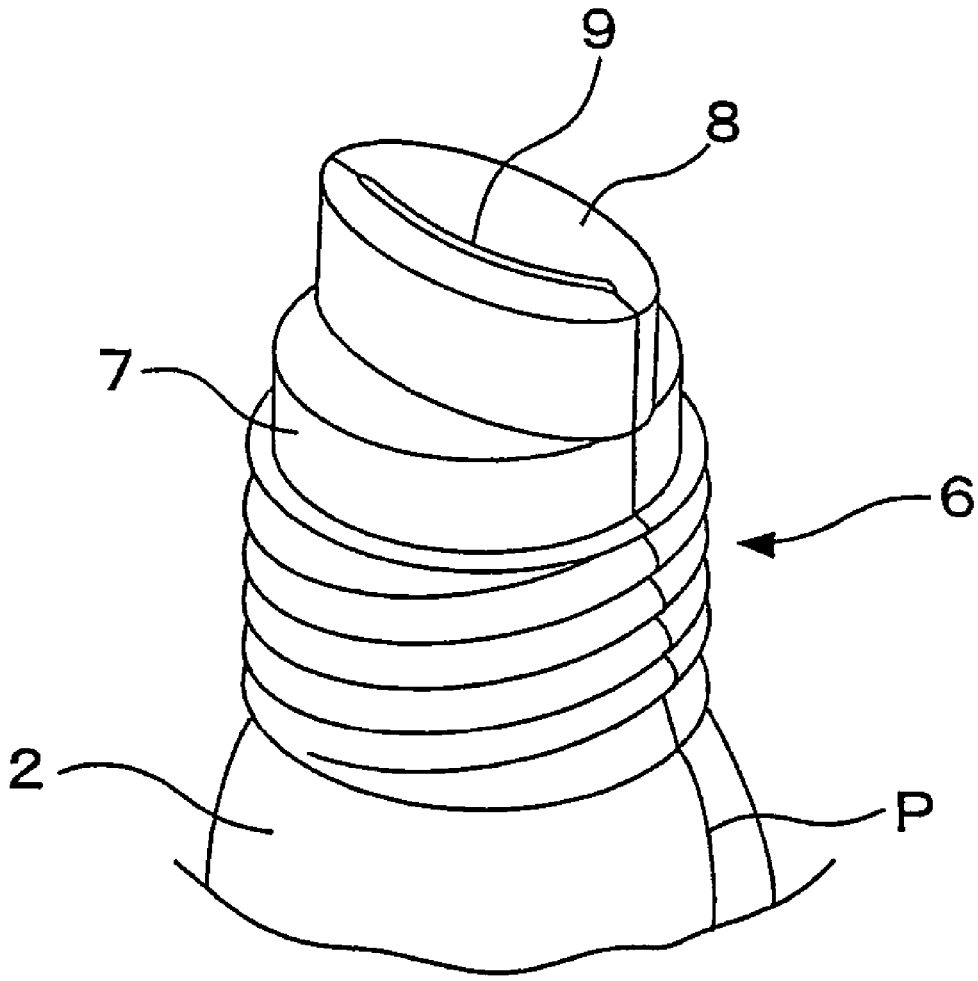
FIG. 13 is a perspective view showing the discharge container in another embodiment.

FIG. 13 shows another embodiment of the discharge container, in which the walled bottom plate 8 of the container 2 is formed in an elliptical shape, with its long axis set in the direction of the parting line P and the length between two opposite mounds 17 of the pinch/push section 18 set shorter than the long axis of the walled bottom plate 8. If the base cup 12 is screwed on the container 2 under this configuration of the discharge container 1, the long-axis portion of the walled bottom plate 8 is pushed by the pinch/push section 18. As a result, the bottom seal 9 is pushed along the direction of the parting line P so as to open the slit 22. This configuration ensures that the walled bottom plate 8 is steadily pushed by the mounds 11 in the direction of the bottom seal 9, and the slit can be opened efficiently.

In addition, the pinch/push section 18 may be molded, not in a circular shape, but in an elliptical or oval shape. In such a case, the walled bottom plate 8 can be in an elliptical or oval shape in which the long axis thereof is longer than the short axis of the pinch/push section. In another case, the walled bottom plate 8 may be molded in a circular shape having a larger outer diameter than the short axis of the pinch/push section 18.

Figure 14:
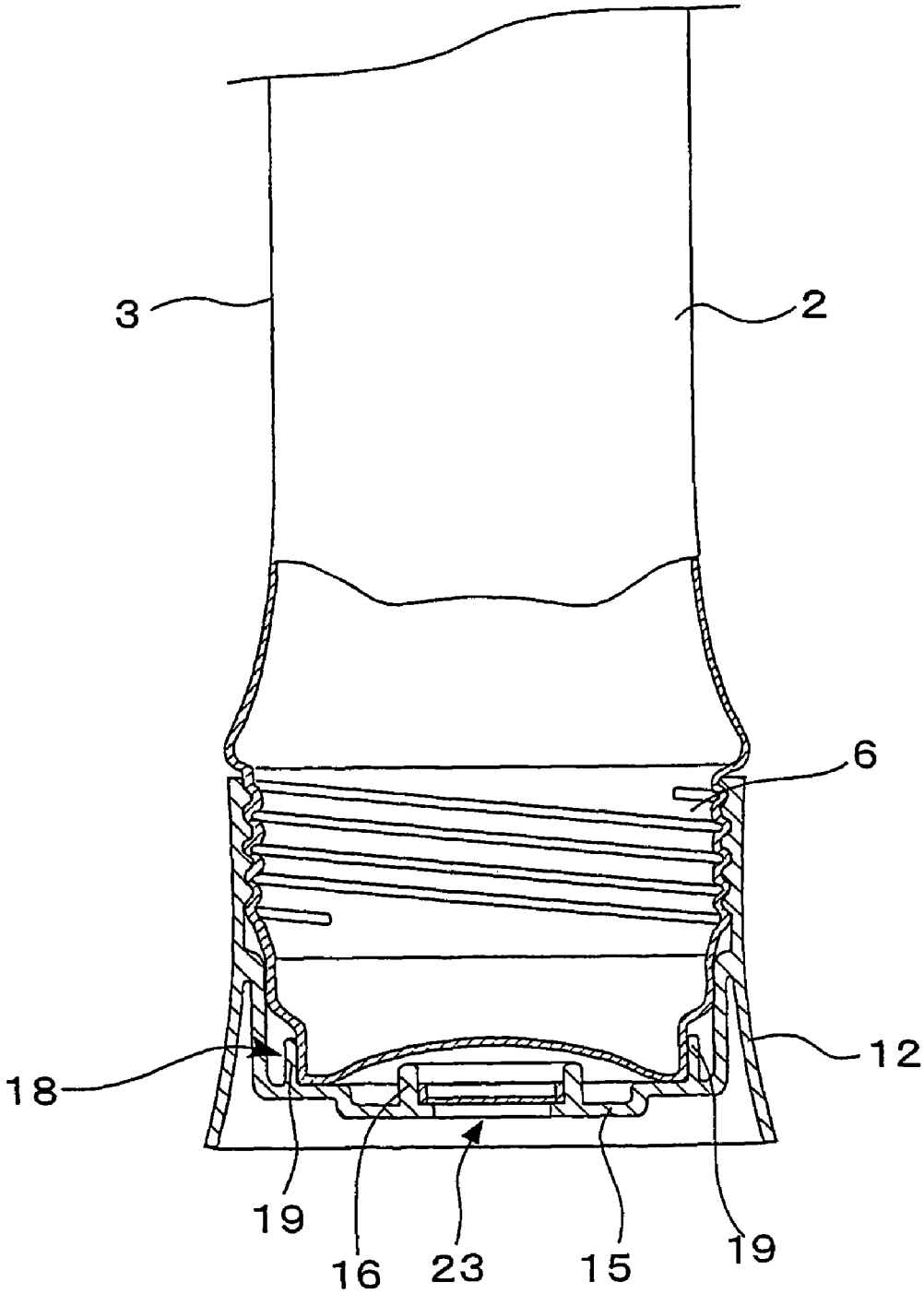
FIG. 14 is a partial vertical section showing the discharge container in still another embodiment.

FIG. 14 shows still another embodiment of the discharge container. In this embodiment, pushing wall portions 19 standing on the cup bottom plate 15 are disposed inside the cylindrical wall 13. The pushing wall portions 19 also serve as the pinch/push section 18. There is some space between each pushing wall portion 19 and the cylindrical wall 13. Because of this space, any reactive force is not transmitted to the female screw 14 by way of the cylindrical wall 13 even if the pushing wall portions 19 push the walled bottom plate 8 and in turn, receive the reactive force.

Even if the pushing wall portions 19 push the walled bottom plate 8 strongly, the cylindrical wall 13 is not affected by the reactive force. There is no effect on the male screw 5 and the female screw 14, and thus, the engagement between these screws remains air-tight. The pushing wall portions 19 may be disposed axisymmetrically in some length inside the cylindrical wall 13, or an entire pushing wall 19 may be disposed circumferentially along the cup bottom cylinder. In the latter case, the shape of the pushing wall 19 is not limited to a circular shape.

Figure 15:
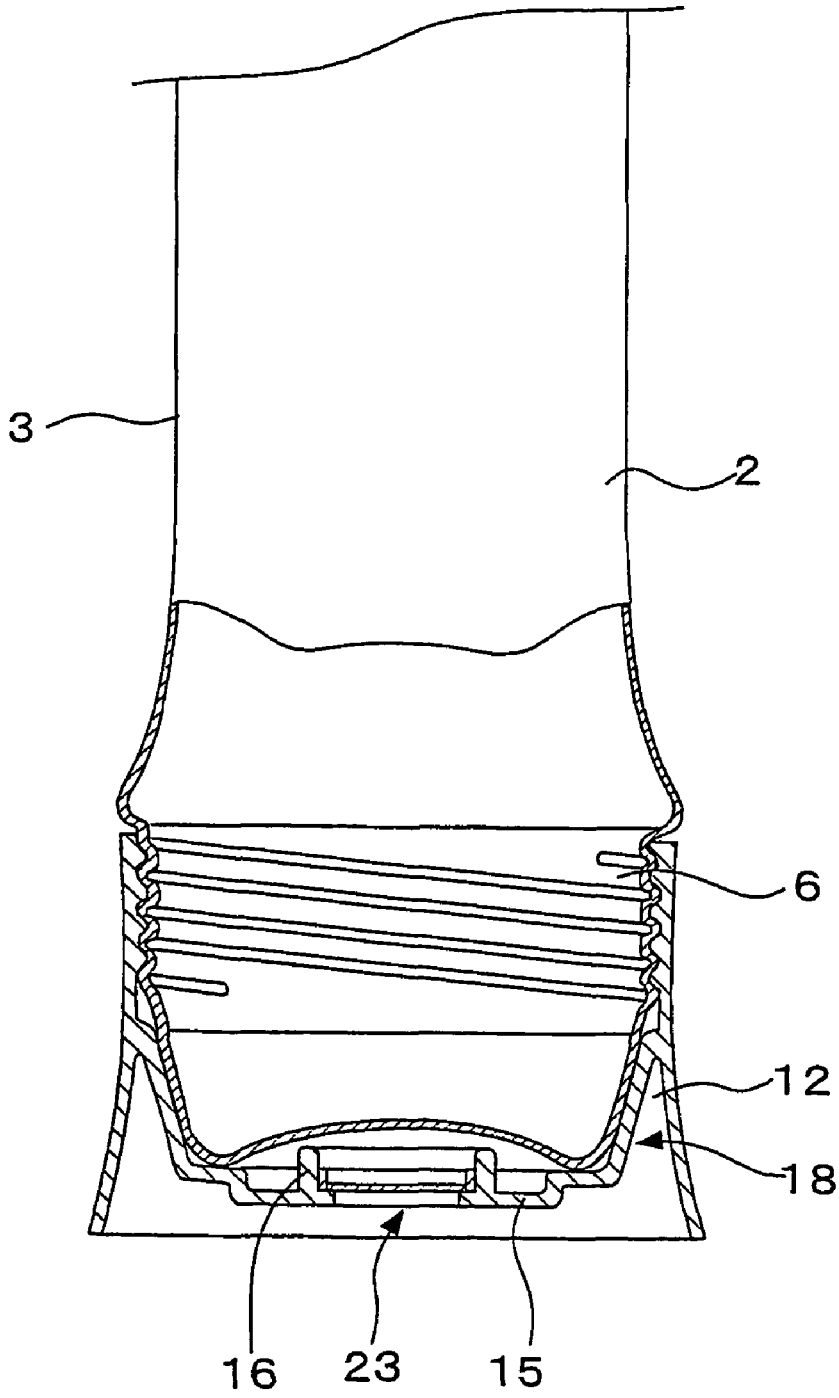
FIG. 15 is a partial vertical section showing the discharge container in yet another embodiment.

FIG. 15 shows yet another embodiment of the discharge container. In this embodiment, the cylindrical wall 13 serving as the pinch/push section 18 is molded into a tapered shape by setting the diameter shorter in the lower portion than in the upper portion. Under this configuration, the deeper the bottom cylinder 6 of the container 2 goes down into the base cup 12 with the progress of screw engagement, the more strongly the walled bottom plate 8 is pushed by the pinch/push section 18, which has smaller diameters at positions nearer to the bottom.

The tapered pinch/push section 18 may also be in the shape of bumps projecting from the inner surface of cup cylindrical wall 13, or in the shape of a peripheral wall running along the cylindrical wall 13, or in the shape of a separate wall inside of, and spaced from, the cylindrical wall 13. In addition, the tapered pinch/push section 18 in the peripheral wall shape may be circular, elliptical, oval, triangular, quadrangular, or polygonal.

Meanwhile, the above embodiments have been described, taking, as an example, a discharge container having a comb/brush attachment. However, the discharge container as described in this invention is not limited to such a type. The neck 4 of the container 2 may be used as the spout of the discharge container, or any applicable unit other than the comb or the brush may be fitted to the container. Other dispensing devices, such as pump, trigger, and spray, may also be fitted to the neck as a component of the discharge container. In addition, the discharge container as described in this invention may be filled not only with the above-described chemical agent, but also with the contents coming from various fields, including cosmetics, toiletry products, and foods.

The position of the air intake hole is not limited to the opening in the center of the cup bottom plate. Though not shown, it is also possible for the air intake hole to be located either at any position in the cup bottom plate. Alternatively, an air intake hole may be provided at a position between the container sidewall and the inner wall of the base cup, where the base cup is engaged with the container. In addition, either the female screw on the inner wall of the base cup or the male screw on the peripheral wall of the container may be provided with a missing portion where the thread ridge is cut out to form an air passage. Furthermore, the method of base cup engagement is not limited to the screw engagement, but undercut engagement can also be a method of choice.

Effects of the Invention

According to the invention as described in claim 1, the discharge container comprises:

a container, which has been blow-molded from cylindrical parison and has a neck disposed in the upper portion of the container in a bottomed cylindrical shape and has said neck connected to discharge ports, through which the contents are discharged, a walled bottom plate in the lower portion of the container, an outer layer and a flexible inner layer that are laminated with each other in a peelable manner, and a bottom seal, which is a pinch-off portion of the parison, formed on the underside of the walled bottom plate; and a base cup, which is fitted to bottom cylinder of the container and comprises a cylindrical wall and a cup bottom plate contiguously formed with the cylindrical wall, wherein the discharge container is characterized in that the container has a first engaging portion on the wall of the bottom cylinder and that the base cup has a second engaging portion, which is disposed on the inner cup wall and is engaged with the first engaging portion, an air intake hole to take in air, and a pushing means to be brought into contact with the container bottom cylinder, and wherein the pushing means comes in contact with the container bottom cylinder and opens a slit in the outer layer of the pinch-off portion when the base cup is fitted around the bottom cylinder of the container by engaging the second engaging portion with the first engaging portion of the container.

Therefore, in the invention as described in claim 1, a slit serving as the air intake hole can be formed easily and reliably because the pushing means comes in contact with the container bottom cylinder so as to open the slit in the outer layer of the bottom seal when the base cup is fitted around the container bottom cylinder.

In the invention as described in claim 2, the pushing means specified in the discharge container of claim 1 is an upright pushing section disposed inside the cup bottom plate, and this pushing section stands upright toward the underside of the walled bottom plate. When the base cup is engaged with the first engaging portion, the upright pushing section pushes up on the walled bottom plate, thus forcing a slit to be opened in the outer layer of the pinch-off portion. The engagement of the base cup with the container allows the upright pushing section to apply the pushing force on the underside of the walled bottom plate, and the base cup is firmly fitted to the container. Because the walled bottom plate is thicker than the body wall, the force of the pushing means to push up on the underside of the walled bottom plate is not deconcentrated but makes the bottom seal so deformed and curved that the slit can be easily and reliably opened in width enough to introduce outside air into the interspace between the outer layer and the inner layer.

In the invention as described in claim 3, the upright pushing section as specified in claim 2 is disposed at a position deviated from the center of the cup bottom plate. Under this configuration, the slit can be opened without fail because the upright pushing section moves in a circular orbit over the underside surface of the walled bottom plate concurrently with the rotation of the base cup while pushing up on the underside.

In the invention as described in claim 4, the upright pushing section specified in claim 2 is disposed in the center of the cup bottom plate. Under this configuration, the upright pushing section directly pushes up on the center of the pinch-off portion and thus, is able to open the slit without fail.

In the invention as described in claim 5, the air intake hole specified in either one of claims 1–3 is disposed in the center of the cup bottom plate. Under this configuration, outside air can be introduced smoothly into the interspace between the outer and inner layers.

In the invention as described in claim 6, the pushing means specified in the discharge container of claim 1 is a pinch/push section, which is disposed inside the base cup and pushes the walled bottom plate laterally from both sides. When the base cup is fitted around the container bottom cylinder, such a pinch/push section pushes the bottom cylinder and opens a slit in the outer layer of the bottom seal. According to the invention as described in claim 6, the pinch/push section pushes the walled bottom plate of the container bottom cylinder laterally during the screw engagement with the base cup. Since the base cup is rotated to push the sidewall gradually, only small power is required for the fitting, and the necessary pushing force can be reliably applied to the walled bottom plate of the bottom cylinder. The slit can be opened easily and reliably in the walled bottom plate so that outside air is introduced into the interspace between the outer layer and the inner layer.

In the invention of claim 7, the discharge container specified in claim 6 is provided with a pinch/push section, which comprises at least a pair of mounds rising from the inner surface of the cup bottom cylinder, with the length between two mounds being shorter than the outer diameter of the bottom plate. Under this configuration, the walled bottom plate of the container bottom cylinder is held tight between the pair of mounds and is pushed laterally. Thus, the slit is formed in the bottom seal without fail.

In the invention as described in claim 8, the pinch/push section of the discharge container specified in claim 6 is formed in the shape of a pushing wall, which is disposed inside the cup cylindrical wall and is allowed to stand from the cup bottom plate, with a narrow space separating the pushing wall from the cylindrical wall. Under this configuration, any reactive force arising from the pressure onto the walled bottom plate is hardly transmitted from the pinch/push section to the female screw, nor has the reactive force any effect to loosen the screw engagement and to break air-tightness between the container and the base cup.

In the invention as described in claim 9, the discharge container specified in either one of claims 6–8 has the configuration that the walled bottom plate is formed in an elliptical or oval shape, with its major axis set in the direction of parting line, and with the length between two mounds of the pinch/push section set shorter than the major axis. This configuration ensures that these mounds apply the pushing force to the walled bottom plate to open a slit in the pinch-off portion easily and reliably as the screw engagement with the base cup goes on.

In the invention as described in claim 10, the pinch/push section of the discharge container specified in either one of claims 6–9 is formed in an elliptical or oval shape, in which the major axis is longer, and the minor axis is shorter, than the outer diameter or major axis of the walled bottom plate of the container. This configuration ensures that the pinch/push section of the base cup holds tight the container bottom cylinder and pushes and deforms the walled bottom plate to open a slit in the pinch-off portion easily and reliably.

In the invention of claim 11, the pinch/push section of the discharge container specified in either one of claims 6–10 is formed in a tapered shape, with its diameter being shorter in the lower portion than in the upper portion. Under this configuration, the walled bottom plate is pushed by large pushing force enough to open the slit reliably in the pinch-off portion when the base cup is screwed on the container.

In the invention as described in claim 12, the squeezable container of the discharge container specified in either one of claims 1–11 comprises: a first check valve, which freely opens or closes the neck of the container to prevent the contents from flowing back into the container and to inhibit the inflow of outside air; and a second check valve fitted to the air intake hole to prevent inside air from escaping outside. Under this configuration, it is possible for the slit to be easily formed in the pinch-off portion even in the case of a relatively soft, squeezable container.

In the invention as described in claim 13 or 14, the engaging portions have a structure in which the first engaging portion specified in either one of claims 1–12 is brought into undercut or screw engagement with the second engaging portion. These configurations ensure that the base cup can be fitted firmly around the container.

The invention claimed is:

1. A discharge container comprising:

a container, which has been blow-molded from cylindrical parison and has a neck disposed in the upper portion of said container in a bottomed cylindrical shape and has said neck connected to discharge ports, through which contents are discharged, a walled bottom plate in the lower portion of said container, an outer layer and a flexible inner layer that are laminated with each other in a peelable manner, and a bottom seal, which is a pinch-off portion of said parison, formed on the underside of said walled bottom plate; and a base cup, which is fitted to bottom cylinder of said container and comprises a cylindrical wall and a cup bottom plate contiguously formed with said cylindrical wall, wherein said discharge container is characterized in that the container has a first engaging portion on the wall of the bottom cylinder and that the base cup has a second engaging portion, which is disposed on the inner cup wall and is engaged with said first engaging portion, an air intake hole to take in air, and a pushing means to be brought into contact with the container bottom cylinder, and wherein said pushing means comes in contact with the container bottom cylinder and opens a slit in the outer layer of the pinch-off portion when the base cup is fitted around the bottom cylinder of said container by engaging the second engaging portion with the first engaging portion of the container.

2. The discharge container according to claim 1 characterized in that said pushing means is an upright pushing section, which is disposed inside the cup bottom plate, stands upright toward underside of said walled bottom plate, and pushes up on this underside so that a slit is opened in the outer layer of the bottom seal when the base cup is fitted around the container bottom cylinder.

3. The discharge container according to claim 2 characterized in that said upright pushing section is disposed at a position deviated from the center of the cup bottom plate.

4. The discharge container according to claim 2 characterized in that said upright pushing section is disposed in the center of the cup bottom plate.

5. The discharge container according to claim 1 characterized in that said air intake hole is disposed in the center of the cup bottom plate.

6. The discharge container according to claim 1 characterized in that said pushing means is a pinch/push section, which is disposed inside the base cup, and pushes the walled bottom plate laterally from both sides so that a slit is opened in the outer layer of the bottom seal by the pushing force of said pinch/push section when the base cup is fitted around the container bottom cylinder.

7. The discharge container according to claim 6 characterized in that said pinch/push section comprises at least a pair of mounds rising from inner surface of the cylindrical wall of said base cup, with the length between two mounds being shorter than the outer diameter of the walled bottom plate.

8. The discharge container according to claim 6, which is characterized in that said pinch/push section is formed as a pushing wall disposed inside the cylindrical wall of the base cup and is raised from the cup bottom plate, with a narrow space separating this pushing wall from the cylindrical wall.

9. The discharge container according to claim 6 characterized in that said walled bottom plate is formed in an elliptical or oval shape, with its major axis set in the direction of the parting line, and the length between two mounds of the pinch/push section set at a length shorter than this major axis of said walled bottom plate.

10. The discharge container according to claim 6 characterized in that said pinch/push section is formed in an elliptical or oval shape, in which the major axis is longer, and the minor axis is shorter, than the outer diameter or major axis of the walled bottom plate.

11. The discharge container according to claim 6, which is characterized in that said pinch/push section is formed in a tapered shape, with its diameter being shorter in the lower portion than in the upper portion.

12. The discharge container according to claim 1, which is characterized in that said container is molded as a squeezable type and comprises: a first check valve, which is disposed at the neck of the container and freely opens or closes the neck to prevent the contents from flowing back into said container and to inhibit the inflow of outside air; and a second check valve fitted to said air intake hole to prevent inside air from escaping outside the base cup.

13. The discharge container according to claim 1, which is characterized in that said first engaging portion is brought into screw engagement with the second engaging portion and therefore that said base cup is fitted to said container by the screw engagement.

14. The discharge container according to claim 1, which is characterized in that the first engaging portion is brought into undercut engagement with the second engaging portion and therefore that said base cup is fitted to said container by the undercut engagement.

* * * * *